US011273347B2

(12) United States Patent
Pettersen et al.

(10) Patent No.: US 11,273,347 B2
(45) Date of Patent: Mar. 15, 2022

(54) GRIP WITH ELECTRONIC SYSTEM AND EXTERIOR VENTING

(71) Applicant: Lamkin Corporation, San Diego, CA (US)

(72) Inventors: Carl W. Pettersen, San Diego, CA (US); Feliciano Guillen Hernandez, Tijuana (MX); Noel Perez Granados, Tijuana (MX)

(73) Assignee: LAMKIN CORPORATION, San Diego, CA (US)

( * ) Notice: Subject to any disclaimer, the term of this patent is extended or adjusted under 35 U.S.C. 154(b) by 138 days.

(21) Appl. No.: 16/926,226

(22) Filed: Jul. 10, 2020

(65) Prior Publication Data

US 2021/0008422 A1 Jan. 14, 2021

Related U.S. Application Data

(60) Provisional application No. 62/873,760, filed on Jul. 12, 2019.

(51) Int. Cl.

| | |
|---|---|
| ***A63B 60/16*** | (2015.01) |
| ***A63B 60/46*** | (2015.01) |
| ***A63B 53/14*** | (2015.01) |
| ***A63B 60/14*** | (2015.01) |
| ***A63B 60/18*** | (2015.01) |

(52) U.S. Cl.

CPC ..... *A63B 60/46* (2015.10); *A63B 53/14* (2013.01); *A63B 60/14* (2015.10); *A63B 60/16* (2015.10); *A63B 60/18* (2015.10); *A63B 2060/464* (2015.10); *A63B 2220/12* (2013.01); *A63B 2220/30* (2013.01); *A63B 2220/44* (2013.01); *A63B 2220/833* (2013.01); *A63B 2225/50* (2013.01)

(58) Field of Classification Search

CPC ..... A63B 60/14; A63B 60/16; A63B 60/18; A63B 53/14; A63B 60/06; A63B 60/46; A63B 2220/12; A63B 2220/30; A63B 2220/44; A63B 2220/833; A63B 2225/50; A63B 2060/464

See application file for complete search history.

(56) References Cited

U.S. PATENT DOCUMENTS 5,897,448 A * 4/1999 Chang ..... A63B 49/08 473/552
9,676,094 B1 * 6/2017 Davis ..... A63B 60/14
(Continued)

*Primary Examiner* — Raleigh W Chiu
(74) *Attorney, Agent, or Firm* — Procopio, Cory, Hargreaves & Savitch LLP

(57) ABSTRACT

Grip with electronic system and exterior venting. In an embodiment, the grip comprises a main body comprising a shaft cavity extending from an open first end to a second end. The grip also comprises an end cap that is attached to the second end of the main body. The end cap comprises a base adjacent to the second end of the main body, which comprises one or more vent openings to one or more vent paths. The end cap also comprises a side wall extending from the base and defining an interior cavity. The end cap further comprises one or more vent paths. Each vent path provides fluid communication between at least one of the vent opening(s) and at least one of one or more vent holes in an exterior surface of the side wall. An electronic system is positioned within the interior cavity of the end cap.

21 Claims, 6 Drawing Sheets

(56) References Cited

U.S. PATENT DOCUMENTS

| | | | | |
|---|---|---|---|---|
| 10,610,753 | B1 * | 4/2020 | Davis | B29C 43/18 |
| 2014/0235364 | A1 * | 8/2014 | Savarese | A63B 53/14 473/223 |
| 2020/0338411 | A1 * | 10/2020 | Nakamura | A63B 53/14 |
| 2020/0338415 | A1 * | 10/2020 | Takasu | A63B 60/42 |
| 2020/0338416 | A1 * | 10/2020 | Mizutani | A63B 60/24 |
| 2020/0384322 | A1 * | 12/2020 | Peters | A63B 53/14 |
| 2021/0008422 | A1 * | 1/2021 | Pettersen | A63B 60/18 |

* cited by examiner

GRIP WITH ELECTRONIC SYSTEM AND EXTERIOR VENTING

CROSS-REFERENCE TO RELATED APPLICATIONS

This application claims priority to U.S. Provisional Patent App. No. 62/873,760, filed on Jul. 12, 2019, which is hereby incorporated herein by reference as if set forth in full.

BACKGROUND

Field of the Invention

The embodiments described herein are generally directed to grips, and, more particularly, to grips (e.g., golf grips) that house an internal electronic system (e.g., sensor system).

Description of the Related Art

Grips for sports implements, such as golf clubs, have taken numerous forms over the years. Early golf grips consisted of a material, such as leather, wrapped in a helical pattern around the handle portion of the golf club. Over the years, golf grips have evolved from wrapped grips to tapered cylinders of rubber, polyurethane, thermoplastic elastomers (TPE), or a similar elastomeric and shock-absorbing material, that slip over the handle end of the shaft of a golf club. Such golf grips are generally formed by compression molding or injection molding.

Grips generally have a hole, aperture, or other opening in an end of the grip to allow air to escape as the grip is being installed on (e.g., slipped over) the shaft of the golf club or other sports implement. However, the incorporation of various electronic systems, such as sensor systems, in these grips can plug or otherwise obstruct this opening. As a result, the grip may become difficult or impossible to install while the electronic system is installed.

SUMMARY

Accordingly, a grip with an electronic system and exterior venting is disclosed for installation on a shaft. In an embodiment, the grip comprises: a main body comprising a shaft cavity extending from an open first end to a second end, wherein the shaft cavity is configured to receive the shaft therein; an end cap attached to the second end of the main body, wherein the end cap comprises a base adjacent to the second end of the main body, wherein the base comprises one or more vent openings to one or more vent paths, a side wall extending from the base, wherein the side wall defines an interior cavity, and the one or more vent paths, wherein each of the one or more vent paths provides fluid communication between at least one of the one or more vent openings and at least one of one or more vent holes in an exterior surface of the side wall; and an electronic system within the interior cavity of the end cap. The main body may be substantially cylindrical. The end cap may be circular in plan view. The side wall of the end cap may be annular. The electronic system may be circular in plan view.

Each of the one or more vent openings may be in a region of the base that defines a base of the interior cavity, so as to provide fluid communication between the shaft cavity of the main body and the interior cavity. Each of the one or more vent paths may comprise a groove that extends outward through an interior surface of the region of the base that defines the base of the interior cavity, and up an interior surface of the side wall, to at least one of the one or more vent holes, such that each vent path provides fluid communication through the interior cavity around the electronic system. The one or more vent openings may consist of a single vent opening in a center of the region of the base that defines the base of the interior cavity. The one or more vent paths may comprise a plurality of vent paths radiating outward from the single vent opening in the center of the region of the base that defines the base of the interior cavity. The plurality of vent paths may be equidistantly spaced apart from each other around a longitudinal axis of the grip. The plurality of vent paths may comprise at least four vent paths. The plurality of vent paths may consist of four vent paths.

In a cross-sectional view along a longitudinal axis of the grip, the side wall may have a first inner diameter around the longitudinal axis, extend from the base for a height h, and curve inward toward the longitudinal axis to a second inner diameter around the longitudinal axis that is less than first inner diameter. The electronic system may have an outer diameter that is equal to or less than the first inner diameter but greater than the second inner diameter, wherein the electronic system has a height that is equal to or less than the height h.

The electronic system may comprise at least one sensor. The electronic system may further comprise: at least one wireless transmitter; and at least one processor configured to transmit data, derived from the at least one sensor, over the at least one wireless transmitter to an external device.

The shaft cavity may be configured in shape and size to receive a handle of a golf club, wherein an exterior surface of the main body is textured. Each of the one or more vent paths may correspond one-to-one with one of the one or more vent openings and correspond one-to-one with one of the one or more vent holes, so as to provide fluid communication between a corresponding vent opening and a corresponding vent hole. Each of the one or more vent paths may comprise a straight linear path between its corresponding vent opening and its corresponding vent hole. The one or more vent holes may be in a top exterior surface of the side wall. The main body may further comprise one or more vent holes through a side of the main body, wherein each of the one or more vent holes in the main body provides fluid communication between the shaft cavity and an exterior of the main body.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

A grip with an electronic system and exterior venting is disclosed in various embodiments. While the grip will be primarily described herein for use as a golf grip on the shaft of a golf club, the grip may be adapted for any sports implement or other type of implement that possesses a handle comprising a shaft. In addition, while the electronic system will be primarily described herein as a sensor system, any type of onboard electronic system may be used in the disclosed grip.

After reading this description, it will become apparent to one skilled in the art how to implement the invention in various alternative embodiments and alternative applications. However, although various embodiments of the present invention will be described herein, it is understood that these embodiments are presented by way of example and illustration only, and not limitation. As such, this detailed description of various embodiments should not be construed to limit the scope or breadth of the present invention as set forth in the appended claims.

1. Grip Overview

Figure 1A:
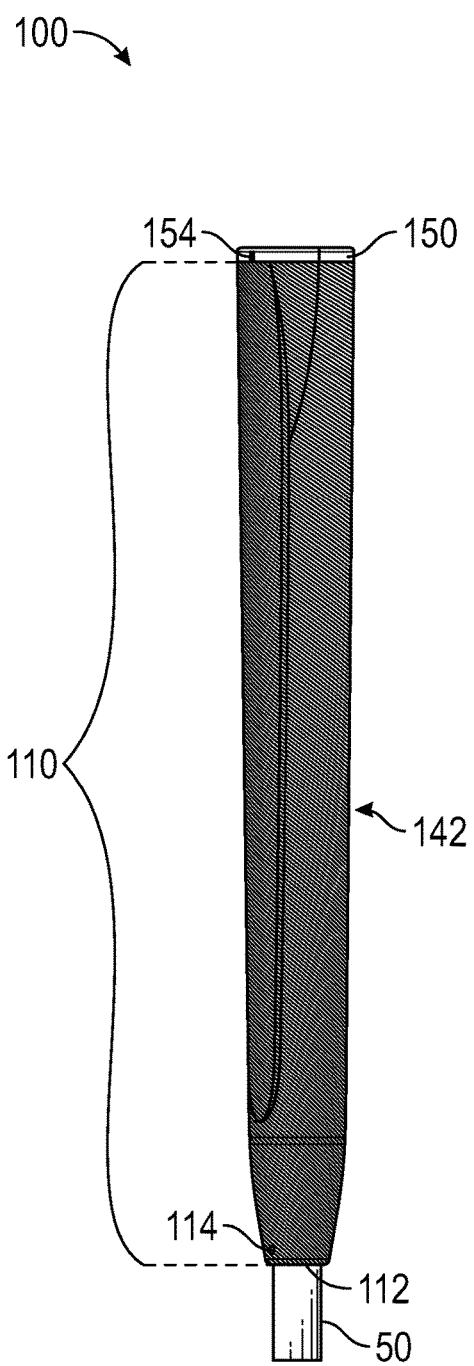
FIGS. 1A-2B illustrate various views of a grip, according to embodiments.
Figure 1B:
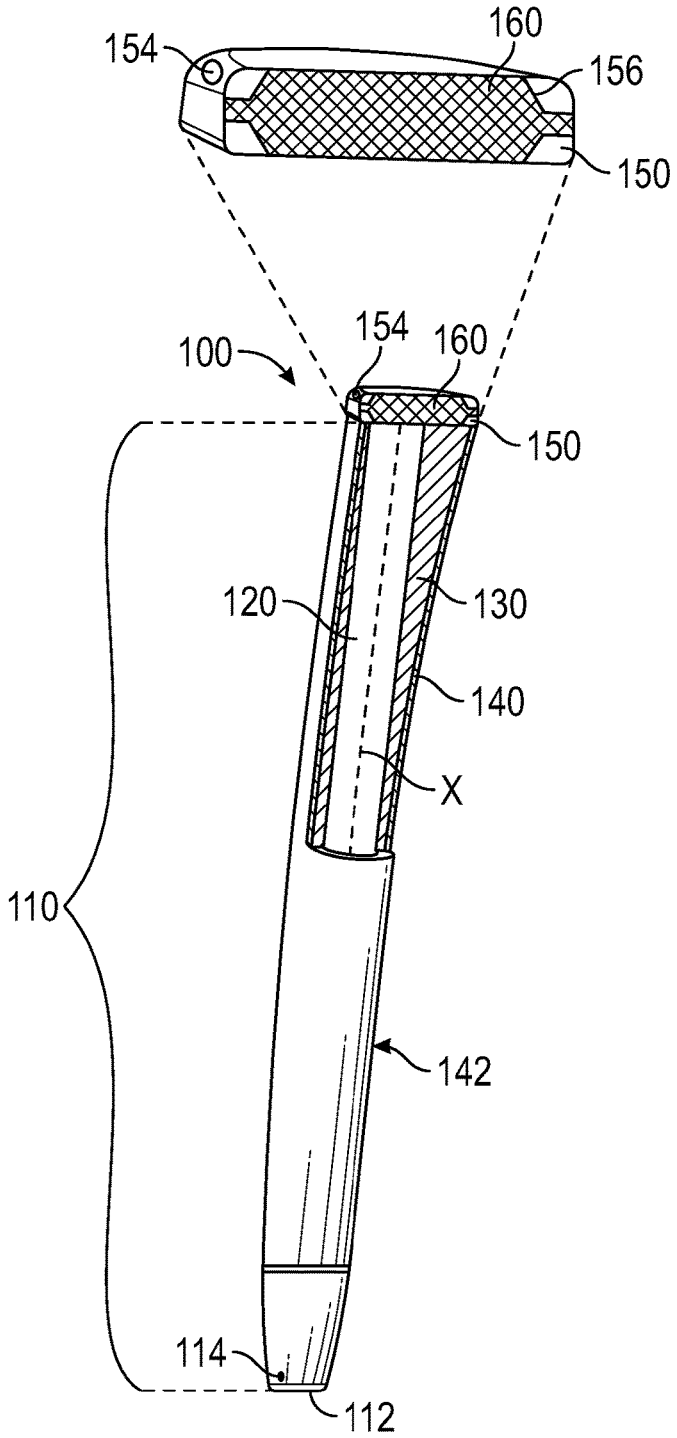

FIG. 1A is a side view of a grip 100 installed on a shaft of a sports implement (e.g., golf club) or other implement, and FIG. 1B is a cut-away view of grip 100 in FIG. 1A, according to an embodiment. As illustrated, grip 100 comprises a main body 110 and an end cap 150 that is attached to one end of main body 110 and closes off that end of main body 110.

Main body 110 may be substantially cylindrical and comprise an interior shaft cavity 120 with an open end 112 that is opposite the closed end of main body 110 formed by end cap 150. Shaft cavity 120 is a substantially cylindrical space with an inner diameter that substantially matches the outer diameter of shaft 50, so as to receive shaft 50 therein. For installation, open end 112 may be slipped over one end of a shaft 50, and main body 110 (e.g., with end cap 150 attached) may be slid over shaft 50, along a longitudinal axis of the shaft, while it is coaxial to longitudinal axis X of shaft cavity 120, to receive shaft 50 snugly within shaft cavity 120 (e.g., such that shaft 50 completely fills shaft cavity 120). In this manner, grip 100 can be installed on the shaft, for example, to facilitate gripping of the shaft by a hand of a user. It should be understood that, in the case that shaft 50 is the handle of a golf club, open end 112 of main body 110 is slipped over the end of the golf club that is opposite the end of the golf club that comprises the club head. Thus, the user may hold grip 100, with shaft 50 therein, as he or she is swinging the golf club.

Main body 110 may comprise an inner layer 130, defining shaft cavity 120, and an outer layer 140 surrounding inner layer 130. As used herein, "inner" represents a smaller radial distance from longitudinal axis X relative to "outer," and "outer" represents a larger radial distance from longitudinal axis X relative to "inner."

Inner layer 130 may comprise foam or another compressible material suitable for establishing a hand grip. For example, inner layer 130 may be a light solid foam with an open-cell or closed-cell structure. In the case that inner layer 130 comprises open-cell foam, the foam may be polyurethane foam. In the case that inner layer 130 comprises closed-cell foam, the foam may be syntactic foam. In either case, inner layer 130 is sized and shaped to define a shaft cavity 120 that snugly or tightly fits a shaft 50 for which grip 100 is designed.

Inner layer 130 may be adjoined to outer layer 140 via bonding. For example, outer layer 140 may be formed around inner layer 130 and bonded to inner layer 130 during the process of forming outer layer 140. Alternatively, inner layer 130 be integral to outer layer 140. In such a case, main body 110 may consist of only a single layer of material. Embodiments of a single layer body for a grip are disclosed in U.S. Pat. No. 9,199,146 ("the '146 patent"), which is hereby incorporated herein by reference as if set forth in full.

Outer layer 140 comprises an outer surface 142, which may facilitate gripping by a hand or hands of a user (e.g., via improved friction over the surface of shaft 50). Outer surface 142 may be smooth or textured, according to the particular design goals of grip 100. In the case of a textured outer surface 142, the texture of outer surface 142 may be molded directly into the material of outer layer 140 or by applying a textured decal around outer layer 140. Examples of raked and textured surfaces are described, in various embodiments, in the '146 patent. In any case, outer layer 140 may be formed from soft or supple material to form a soft, outer shell around main body 110, or hard material to form a hard, outer shell around main body 110.

In an embodiment, main body 110 comprises one or more vent holes 114 near open end 112 to facilitate installation of grip 100 onto shaft 50. For example, vent hole(s) 114 may be positioned a short distance from open end 112 and provide a channel through outer surface 142, outer layer 140, inner layer 130, and an inner surface of inner layer 130, into shaft cavity 120, such that air may be expelled from shaft cavity 120 as grip 100 is installed over shaft 50.

2. End Cap

In an embodiment, end cap 150 is integral to main body 110. For example, end cap 150 may be molded as a unitary structure with main body 110, or molded separately and then joined to main body 110 via bonding (e.g., head bonding), adhesive, corresponding fasteners (e.g., mating threads, hooks and loops, etc.), and/or the like. End cap 150 may be permanently joined to main body 110 or detachably joined to main body 100. In any case, end cap 150 may be integrated with main body 110 prior to the installation of grip 100 on shaft 50.

End cap 150 may comprise one or more vent holes 154. Similarly to vent hole(s) 114, vent hole(s) 154 in end cap 150 provide a fluid communication channel from shaft cavity 120, through end cap 150, to an exterior of grip 100. Thus, vent hole(s) 154 enable air to escape or be expelled from shaft cavity 120 as grip 100 is installed over shaft 50. It should be understood that vent hole(s) 154 may be positioned anywhere on an exterior surface of end cap 150, including the top of end cap 150 and/or the sides of end cap 150.

In addition, end cap 150 may comprise an interior cavity 156 that is sized, shaped, and otherwise configured to hold an electronic system 160. Interior cavity 156 may be molded or otherwise formed within end cap 150, so as to at least partially surround and securely hold electronic system 160 in place. For example, interior cavity 156 may snugly cover at least the edges and/or corners of electronic system 160 to fix the position of electronic system within end cap 150. Interior cavity 156 may be sized to hold a particular electronic system 160 or a plurality of different types of electronic systems 160. Electronic system 160 may be fit within end cap 150 before or after end cap 150 has been affixed to main body 110 (e.g., as part of the molding process of grip 100).

Electronic system 160 may comprise one or more electronic sensors that, individually or collectively, sense one or more parameters of location, motion, orientation, and/or the like. For example, one or more sensors of electronic system 160 may be configured to sense a speed or velocity of electronic system 160, an acceleration of electronic system 160, an orientation of electronic system 160 in three-dimensional space, a position and/or orientation of a user's hand on grip 100, a pressure applied by a hand of the user on grip 100, and/or other applicable data. For example, in the case that shaft 50 is the handle of a golf club, the sensor of electronic system 160 may be used to sense the speed, velocity, and/or acceleration of the user's golf swing, the orientation of the golf club, the manner in which the user is holding the golf club, and/or the like. Electronic system 160 may be configured to store the sensed data in onboard memory and/or transmit the data to an external device (e.g., mobile device, such as a smartphone, tablet computer, or laptop computer, a desktop computer, a server, or any other external processing system) over a wireless and/or wired connection. Any conventional wireless communication protocol (e.g., Wi-Fi™, Bluetooth™, etc.) or wired communication protocol (e.g., Universal Serial Bus (USB), Ethernet, etc.) may be used to transmit the data.

As an example, electronic system 160 may comprise a Global Positioning System (GPS) receiver that provides the three-dimensional location (e.g., as coordinates of latitude, longitude, and elevation) of electronic system 160, a gyroscopic sensor to determine an orientation of electronic system 160 at the three-dimensional location, and/or one or more accelerometers to measure acceleration of electronic system 160 at the orientation at the three-dimensional location. Additional data can be measured, calculated, and/or extrapolated from sensor(s) in electronic system 160.

Electronic system 160 may also comprise one or more processors that can perform simple and/or complex calculations and/or one or more memories that can store software (e.g., firmware, applications, etc.) and/or data (e.g., pre-stored reference data, data received over a wireless or wired communication connection, etc.). For example, in the case that shaft 50 is the handle of a golf club, the processor(s) may be configured to calculate a distance to a hole (e.g., based on the three-dimensional location), provide a recommendation of a golf club to use for a shot (e.g., based on the calculated distance to the hole), and/or the like.

Alternatively or additionally, electronic system 160 may comprise a wireless radio frequency (RF) transmitter or transceiver that wirelessly transmits data, collected by one or more onboard sensors (e.g., three-dimensional location, orientation, acceleration, speed, etc.), to an external wireless-enabled device (e.g., smartphone, personal computer, etc.). In this case, the external device may comprise one or more processors that perform the calculations (e.g., distance) or additional calculations, generate recommendations, and/or the like, and a display that displays the results of the calculations and/or the recommendations. Alternatively, the external device may relay the data to a remote platform (e.g., cloud-based web service) over one or more networks (e.g., including the Internet) to have calculations performed, recommendations and/or feedback generated, and/or the like, and then returned to the external device for display. The external device and/or remote platform may apply artificial intelligence (AI), including machine-learning models, to the data (e.g., three-dimensional location, orientation, acceleration, speed, distance, etc.) to generate the recommendations and/or other feedback (e.g., club selection, improvements to grips and/or swing motion, etc.).

Figure 2A:
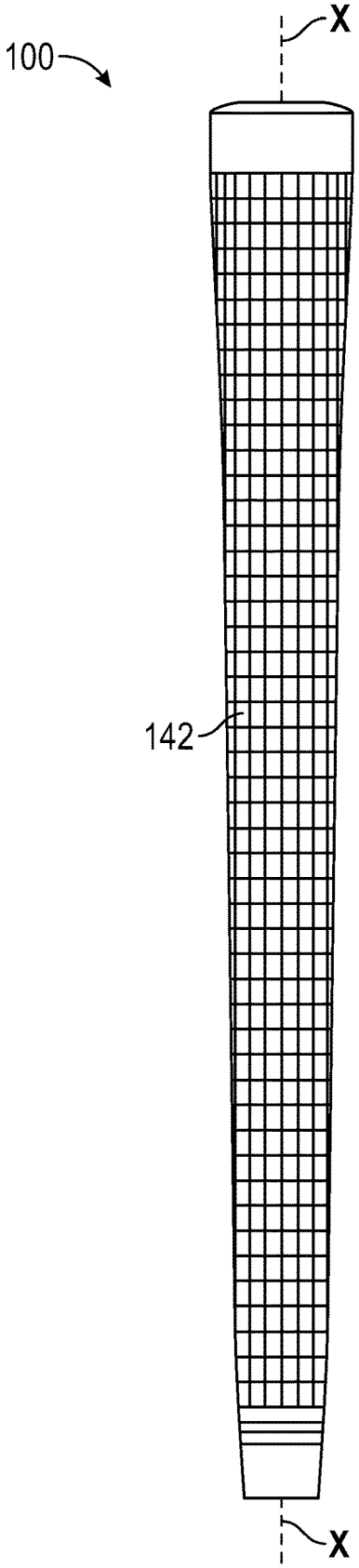
Figure 2B:
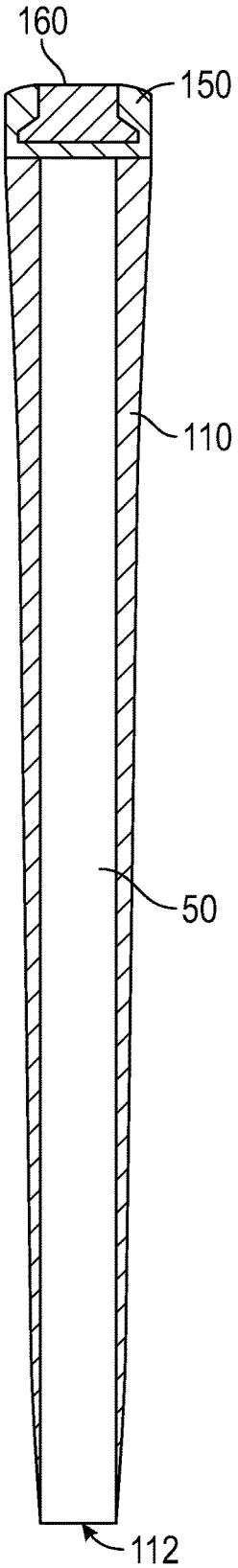

FIG. 2A is a side view of a grip 100, and FIG. 2B is a cross-sectional view of grip 100 in FIG. 2A along its longitudinal axis X, according to an embodiment. Grip 100 in FIGS. 2A and 2B is similar to grip 100 in FIGS. 1A and 1B. Since the components are generally the same or similar, they will not be redundantly described herein. Rather, it should be understood that the description of the components of grip 100 in FIGS. 1A and 1B apply equally to the components of grip 100 in FIGS. 2A and 2B.

Figure 3:
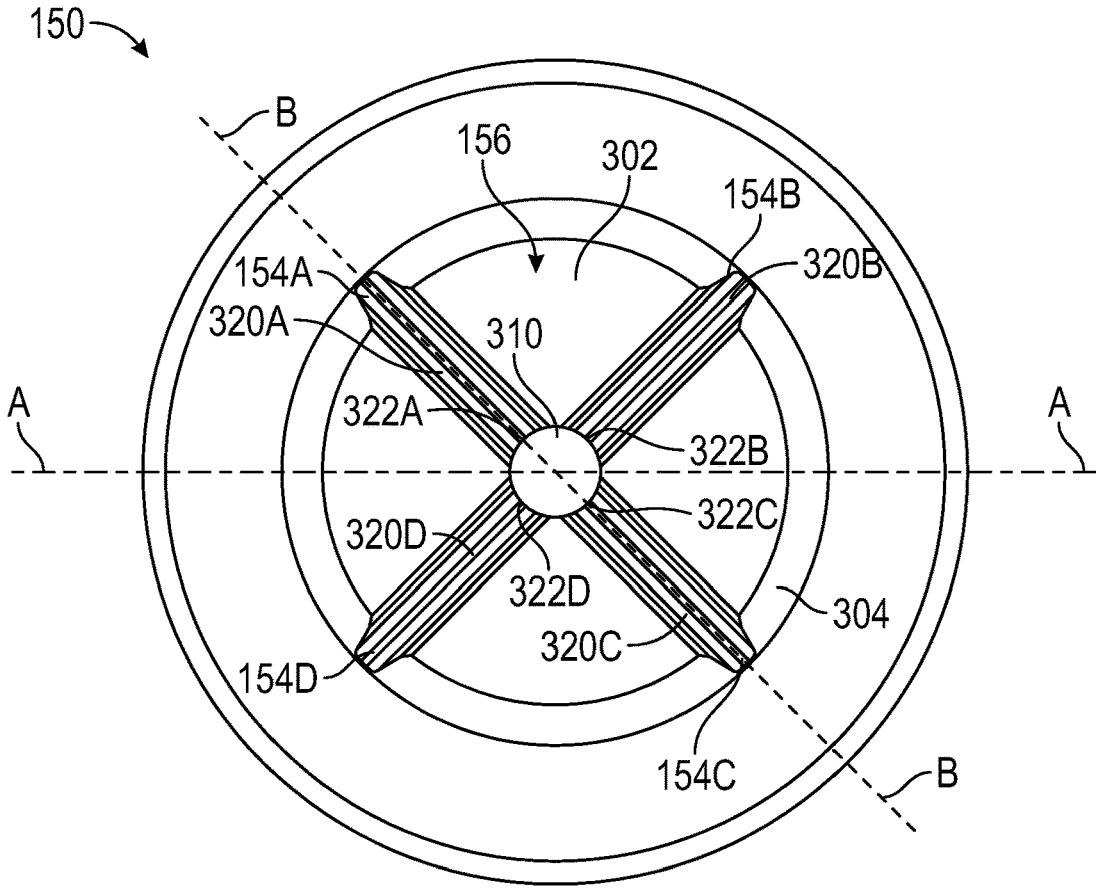
FIGS. 3-6 illustrate various views of an end cap of a grip, according to embodiments.

FIG. 3 is a top plan-view of end cap 150 of grip 100, according to an embodiment. To show the internal features of end cap 150, end cap 150 is shown without electronic system 160, which would otherwise be installed in interior cavity 156. As illustrated, end cap 150 is substantially circular or annular in plan view, and comprises an interior cavity 156, defined by a base 302 and an interior surface of a side wall 304. Notably, base 302 divides interior cavity 156 from shaft cavity 120. Base 302 comprises at least one vent opening 310 (e.g., in a region forming the base of interior cavity 156) that is connected to one or more vent pathways 320. Vent opening 310 provides fluid communication between shaft cavity 120 of main body 110 and interior cavity 156 of end cap 150. In addition, vent opening 310 provides fluid communication to one or more vent paths 320 through vent entries 322, and each vent path 320 provides fluid communication through end cap 150 to a vent hole 154. While vent holes 154 are shown on the top surface of end cap 154, one or more vent paths 320 could instead curve outward through side wall 304 to vent hole(s) 154 on an exterior side surface of side wall 304, so as to dispel fluid out of the sides of end cap 150. In any case, during installation of grip 100 to shaft 50, displaced air may flow through the closed end of main body 110, via a fluid pathway from shaft cavity 120, through vent opening(s) 310, through vent entry(ies) 322 into and through vent path(s) 320, and out of vent hole(s) 154 to an outside environment. In addition, during manufacturing, when end cap 150 is joined to main body 110, this fluid pathway from shaft cavity 120 to vent hole(s) 154 may be used to evacuate diffused installation solvent from shaft cavity 120.

As shown, end cap 150 may comprise a single vent opening 310 and a plurality of vent paths 320 that each provide a path from a respective vent entry 322 to a respective vent hole 154. Specifically, four vent paths 320A-320D radiate from a single circular vent opening 310 in the center of circular base 302. In the illustrated embodiment, vent entry 322A, vent path 320A, and vent hole 154A form a first fluid pathway, vent entry 322B, vent path 320B, and vent hole 154B form a second fluid pathway, vent entry 322C, vent path 320C, and vent hole 154C form a third fluid pathway, and vent entry 322D, vent path 320D, and vent hole 154D form a fourth fluid pathway. However, it should be understood that alternative embodiments may comprise a plurality of vent openings 310 and/or a different number of vent paths 320 (e.g., one, two, three, five, six, etc. vent paths 320). In each embodiment, each vent path 320 should provide a fluid pathway between a vent entry 322 to at least one vent opening 310 and a vent hole 154. In embodiments with a plurality of vent paths 320, each vent path 320 may be equidistantly spaced from any adjacent vent path 320, around longitudinal axis X (which comes out of the page from the center of vent opening 310 in FIG. 3). For example, in the illustrated embodiment, the four vent paths 320 and their corresponding vent entries 322 and vent holes 154 are each oriented orthogonally at right angles from their adjacent vent paths 320, so as to be spaced 90° from each adjacent vent path 320 around longitudinal axis X of end cap 150.

In an embodiment, each vent path 320 comprises a groove that extends from a vent entry 322 to vent opening 310 through base 302 and up an interior surface of side wall 304 to vent hole 154. In the illustrated embodiment, the groove of each vent path 320 is open to interior cavity 156. Advantageously, this can improve manufacturability. For instance, during manufacture, each groove may be molded into the surfaces of interior cavity 156, corresponding to the interior surfaces of base 302 and side wall 304, to provide a channel that will not be obstructed by electronic system 160. Specifically, when electronic system 160 is seated within interior cavity 156, the surfaces of electronic system 160 will generally be flush with base 302 and the interior surface of side wall 304, without extending into the grooves. Thus, electronic system 160 does not obstruct the grooves, and fluid (e.g., air) may easily flow through the grooves from vent opening 310 around electronic system 160 and out of vent holes 154. In other words, grip 100 may be installed on shaft 50, even while electronic system 160 is within interior cavity 156. Specifically, as grip 100 is slid over shaft 50, to receive shaft 50 within shaft cavity 120, the air in shaft cavity 120 is displaced, along longitudinal axis X, through vent opening 310. This displaced air is guided through vent entry(ies) 322 into vent path(s) 320. In turn, vent path(s) 320 guide the displaced air from shaft cavity 120 around electronic system 160 and out of vent hole(s) 154, so that grip 100 may be more easily installed on a shaft 50. It should be understood that, in embodiments which have vent hole(s) 114 in main body 110, air may simultaneously be displaced out vent hole(s) 114 in main body 110.

Figure 4A:
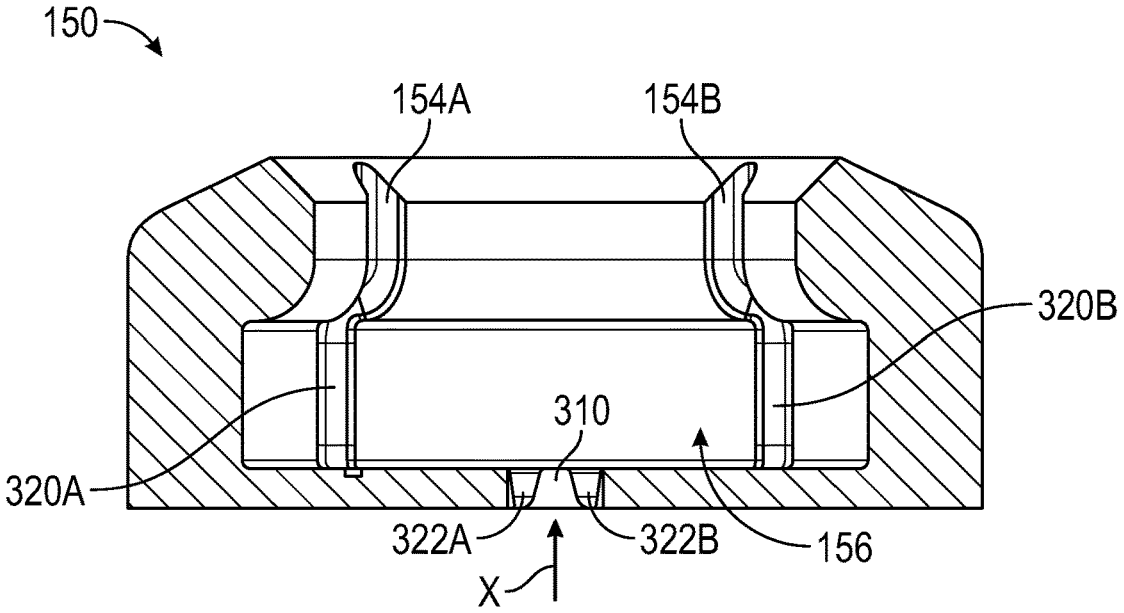
Figure 4B:
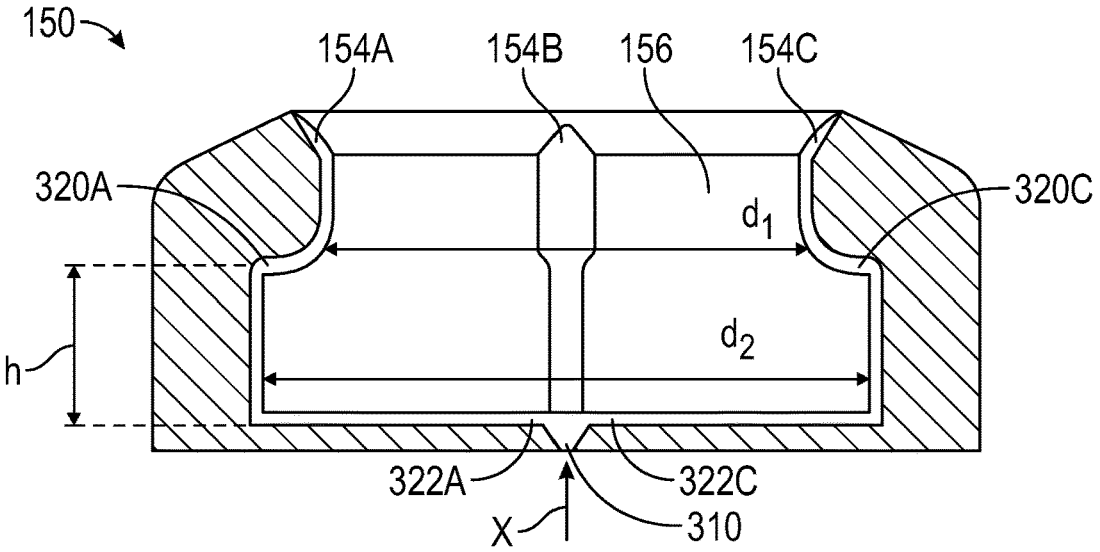
Figure 5A:
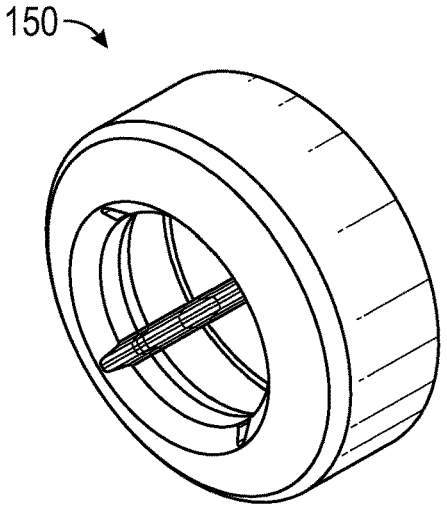
Figure 5B:
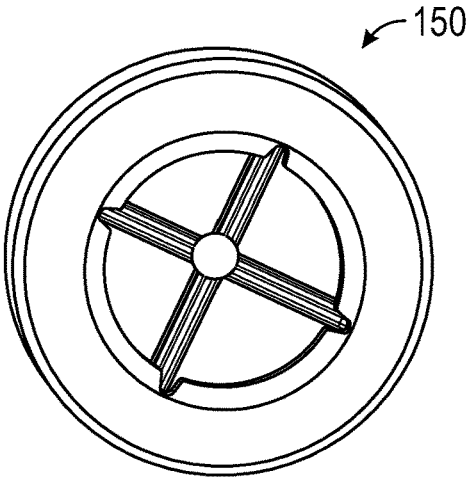
Figure 5C:
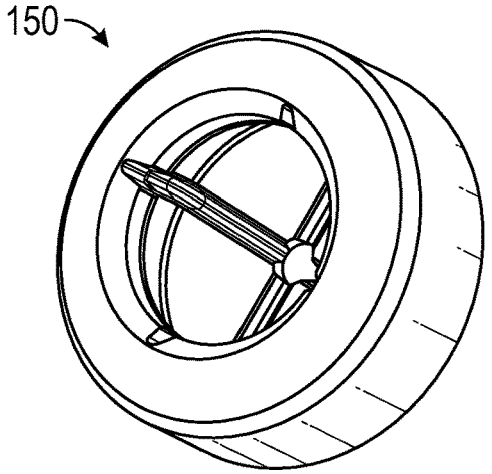
Figure 5D:
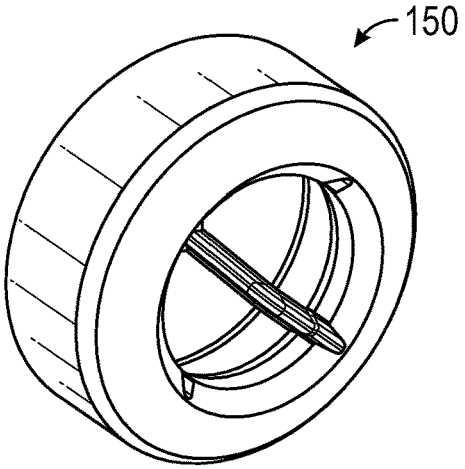

FIG. 4A is a cross-sectional view of end cap 150 in FIG. 3, along the line A-A in FIG. 3, according to an embodiment, and FIG. 4B is a cross-sectional view of end cap 150 in FIG. 3, along the line B-B in FIG. 3, according to an embodiment. FIG. 5 provides four different perspective views of the end cap 150 in FIGS. 3-4B, according to an embodiment. To clearly show the features of end cap 150, electronic system 160 is omitted from FIGS. 4A-5.

As illustrated in FIGS. 4A and 4B, the interior surface of side wall 304, including the grooves of vent paths 320, may extend orthogonally from base 304, away from main body 110, with an inner diameter $d_1$ for a height h, and then curve towards longitudinal axis X until reaching an inner diameter $d_2$, which is less than diameter $d_1$. Accordingly, interior cavity 156 is configured to hold an electronic system 160 that is circular (e.g., puck shaped) with an outer diameter $d_1$ and a height h. However, it should be understood that the interior surface of side wall 304 may be configured with a different shape and/or different dimensions to accommodate the shape and dimensions of any desired electronic system 160.

End cap 150 may be made from elastic material, such that electronic system 160 may be pushed into interior cavity 156 during manufacture. In this case, side wall 304 can be configured to flex outwards to temporarily increase inner diameter $d_2$, so that electronic system 160 can pass through and be seated in interior cavity, then flex inward to return to its original inner diameter $d_2$. Since the original inner diameter $d_2$ of side wall 304 at the top of end cap 150 is less than the outer diameter $d_1$ of electronic system 160, side wall 304 covers a peripheral edge of the top surface of electronic system 160, thereby preventing electronic system 160 from sliding or otherwise falling out of interior cavity 156. To more securely retain electronic system 160, the top of interior cavity 156 may be sealed during manufacture by fixing a piece with an outer diameter of substantially $d_2$ within the inner diameter $d_2$ of side wall 304 via bonding (e.g., head bonding), adhesive, corresponding fasteners (e.g., mating threads, hooks and loops, etc.), and/or the like. In any case, the seal may be waterproof or water resistant to reduce or prevent the intrusion of water, dust, or other substances into interior cavity 156. Alternatively or additionally, electronic system 160 may itself be waterproof to prevent any malfunction or failure due to the intrusion of such substances into interior cavity 156.

Figure 6:
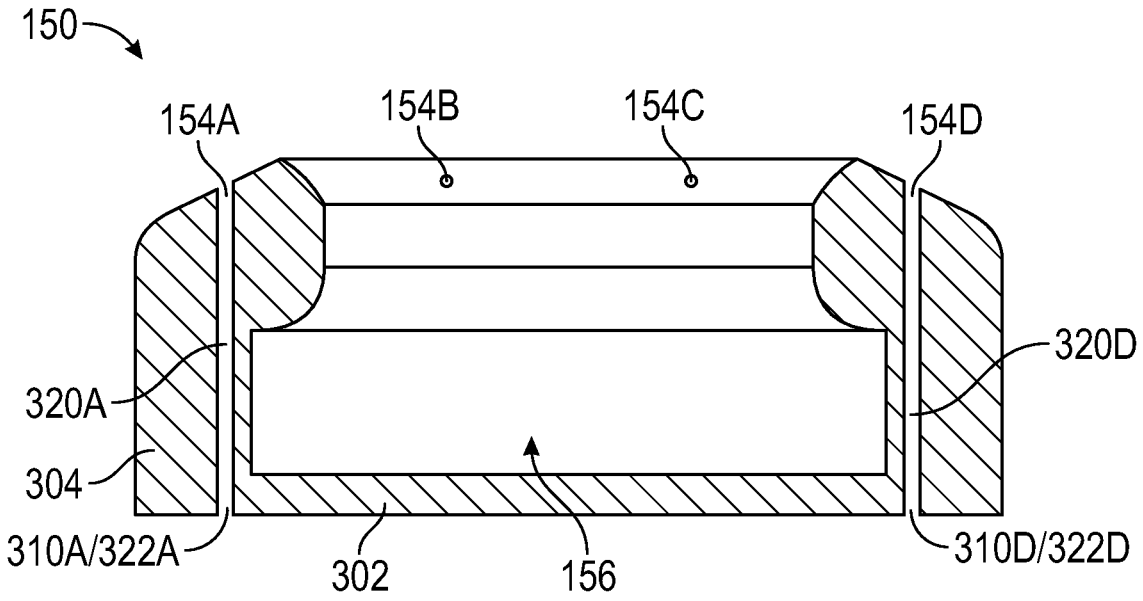

FIG. 6 is a cross-sectional view of end cap 150, according to an alternative embodiment to the embodiment illustrated in FIGS. 3-5. This embodiment differs from that embodiment in that each vent path 320 is fully enclosed within annular side wall 304 and provides a straight path between its respective vent entry 322 (also representing a vent opening 310 in base 304, to provide fluid communication between shaft cavity 120 and vent path 320) and vent hole 154. Alternatively, each vent path 320 could curve outward to vent holes 154 on an exterior side surface of side wall 304, instead of a top surface of side wall 304, so as to dispel fluid out of the sides of end cap 150. Notably, in the embodiment in FIG. 6, there is no vent opening 310 into interior cavity 156. Accordingly, fluid (e.g., air) from shaft 120 is not vented through interior cavity 156 and never enters interior cavity 156.

As with the first embodiment, this second embodiment of end cap 150 may comprise any number of vent paths 320. In the cross-section illustrated in FIG. 6, there are four vent paths 320, which each have a respective vent entry 322 and vent hole 154. It should be understood that, since this is one half of end cap 150, the whole end cap 150 in this embodiment would have eight such vent paths. Alternatively, this embodiment may have fewer (e.g., one, two, three, four, five, six, seven) or more (e.g., nine, ten, fifteen, twenty, etc.) vent paths 320.

In this second embodiment, electronic system 160 may be inserted and sealed within interior cavity 156 in the same manner as in the first embodiment. One advantage of this second embodiment is that, since fluid never enters interior cavity 156, there is no danger of electronic system 160 being exposed to fluid. This can be especially advantageous if electronic system 160 is not waterproof.

3. Example Electronic System

Figure 7:
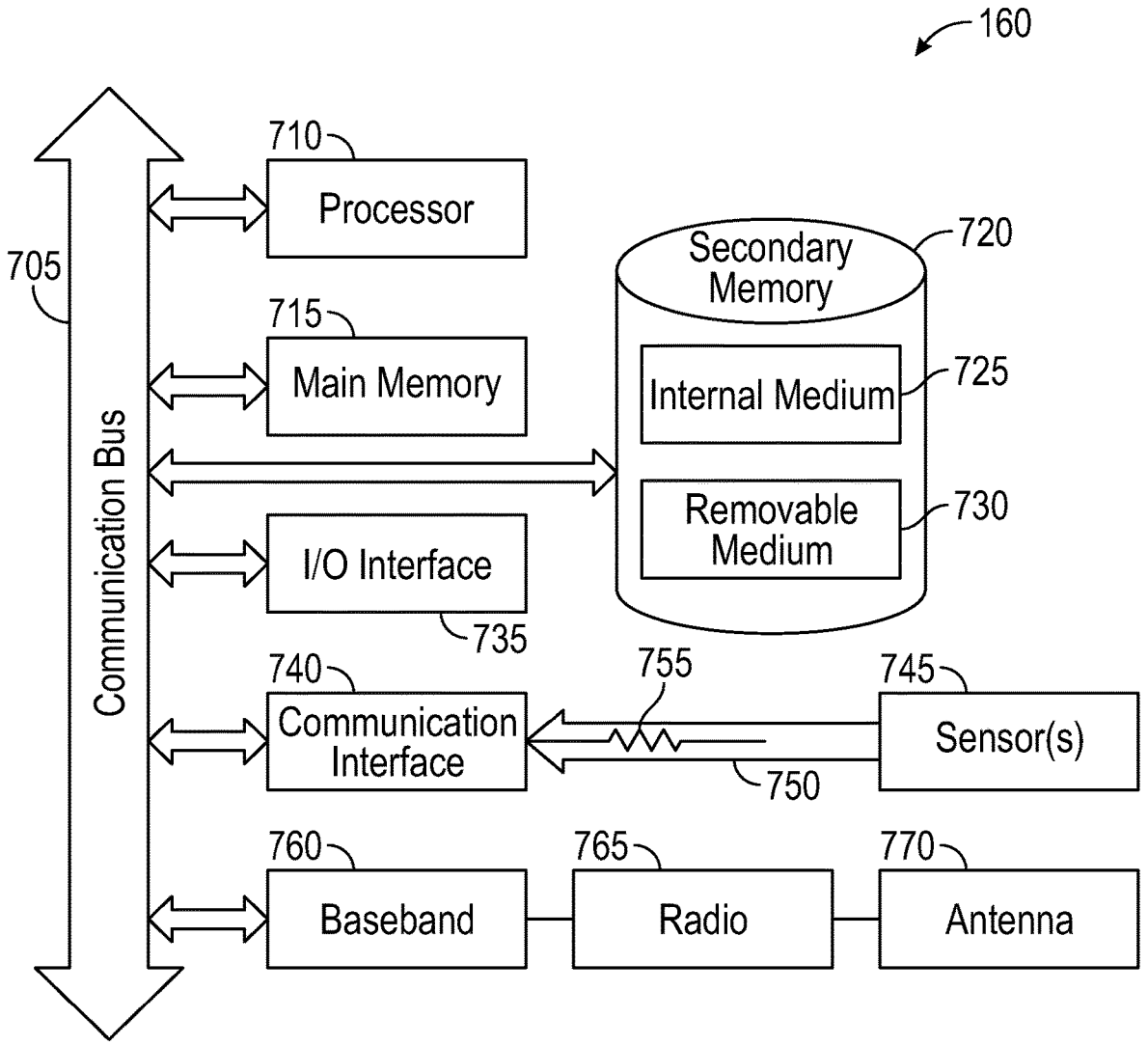
FIG. 7 illustrates an example electronic system, according to an embodiment.

FIG. 7 is a block diagram illustrating an example electronic system 160 that may be used in connection with embodiments of grip 100 described herein. Specifically, electronic system 160 may be installed in interior cavity 156 of the disclosed end cap 150. Other computer systems and/or architectures may be also used, as will be clear to those skilled in the art.

Electronic system 160 may comprise one or more processors 710. Additional processors may be provided, such as an auxiliary processor to manage input/output, an auxiliary processor to perform floating-point mathematical operations, a special-purpose microprocessor having an architecture suitable for fast execution of signal-processing algorithms (e.g., digital-signal processor), a slave processor subordinate to the main processing system (e.g., back-end processor), an additional microprocessor or controller for dual or multiple processor systems, and/or a coprocessor. Such auxiliary processors may be discrete processors or may be integrated with processor 710. However, in many applications, a simple, lightweight central processing unit (CPU) will suffice as processor 710 for electronic system 160.

Processor 710 is preferably connected to a communication bus 705. Communication bus 705 may include a data channel for facilitating information transfer between storage and other peripheral components of electronic system 160. Furthermore, communication bus 705 may provide a set of signals used for communication with processor 710, including a data bus, address bus, and/or control bus (not shown). Communication bus 705 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, standards promulgated by the Institute of Electrical and Electronics Engineers (IEEE)

including IEEE 488 general-purpose interface bus (GPIB), IEEE 696/S-100, and/or the like.

Electronic system 160 may include a main memory 715, and may also include a secondary memory 720. Main memory 715 provides storage of instructions and data for programs executing on processor 710. It should be understood that programs stored in the memory and executed by processor 710 may be written and/or compiled according to any suitable language, including without limitation C/C++, Java, JavaScript, Perl, Visual Basic, .NET, and the like. Main memory 715 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

Secondary memory 720 may optionally include an internal medium 725 and/or a removable medium 730. Secondary memory 720 is a non-transitory computer-readable medium having computer-executable code and/or other data stored thereon. The computer software or data stored on secondary memory 720 may be read into main memory 715 for execution by processor 710. Internal medium 725 and/or removable medium 730 may be read from and/or written to in any well-known manner. Examples of secondary memory 720 may include semiconductor-based memory, such as programmable read-only memory (PROM), erasable programmable read-only memory (EPROM), electrically erasable read-only memory (EEPROM), and flash memory (block-oriented memory similar to EEPROM). Removable storage medium 730 may be, for example, a secure digital (SD) card (e.g., a microSD flash memory card).

Computer-executable code (e.g., computer programs) and/or data are stored in main memory 715 and/or secondary memory 720. Data can also be received via communication interface 740 and stored in main memory 715 and/or secondary memory 720. The computer-executable code, when executed, enables electronic system 160 to perform the various functions of the disclosed embodiments as described elsewhere herein.

Electronic system 160 may include a communication interface 740. Communication interface 740 allows data to be transferred between one or more sensors 745 and processor 710, main memory 715, and/or secondary memory 720. Sensor(s) 745 may comprise any one or more of the sensors described herein, including, without limitation, a GPS receiver, gyroscope, accelerometer, and/or the like. Data transferred via communication interface 740 are generally in the form of electrical communication signals 755. These signals 755 may be provided to communication interface 740 via a communication channel 750. Communication channel 750 carries signals 755 and can be implemented using a variety of wired or wireless communication means including wire or cable, fiber optics, wireless data communication link, radio frequency ("RF") link, or infrared link, just to name a few.

In an embodiment, I/O interface 735 provides an interface between one or more components of electronic system 160 and one or more external input and/or output devices. For example, I/O interface 735 may comprise a physical port (e.g., USB port) in the housing of electronic system 160 that enables electronic system 160 to be connected to an external device (e.g., to transfer data to the external device and/or receive data from the external device).

In an embodiment electronic system 160 may also comprise a battery (not shown), which powers the illustrated components of electronic system 160. The battery may be rechargeable. In this case, the battery may be rechargeable via an electrical connection to I/O interface 735 (e.g., via a micro USB connection).

Electronic system 160 may also include optional wireless communication components that facilitate wireless communication over a voice network and/or a data network (e.g., cellular network, Wi-Fi™ network, etc.) and/or with an external device via near-field or other short-range wireless communication (e.g., via Bluetooth™). The wireless communication components comprise an antenna system 770, a radio system 765, and a baseband system 760, which is communicatively coupled with processor 710. In electronic system 160, radio frequency (RF) signals are transmitted and received over the air by antenna system 770 under the management of radio system 765.

In an embodiment, antenna system 770 may comprise one or more antennae and one or more multiplexors (not shown) that perform a switching function to provide antenna system 770 with transmit and receive signal paths. In the receive path, received RF signals can be coupled from a multiplexor to a low noise amplifier (not shown) that amplifies the received RF signal and sends the amplified signal to radio system 765.

In an alternative embodiment, radio system 765 may comprise one or more radios that are configured to communicate over various frequencies. In an embodiment, radio system 765 may combine a demodulator (not shown) and modulator (not shown) in one integrated circuit (IC). The demodulator and modulator can also be separate components. In the incoming path, the demodulator strips away the RF carrier signal leaving a baseband receive audio signal, which is sent from radio system 765 to baseband system 760.

The above description of the disclosed embodiments is provided to enable any person skilled in the art to make or use the invention. Various modifications to these embodiments will be readily apparent to those skilled in the art, and the general principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

Combinations, described herein, such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, and any such combination may contain one or more members of its constituents A, B, and/or C. For example, a combination of A and B may comprise one A and multiple B's, multiple A's and one B, or multiple A's and multiple B's.

What is claimed is:

1. A grip for installation on a shaft, the grip comprising:
a main body comprising a shaft cavity extending from an open first end to a second end, wherein the shaft cavity is configured to receive the shaft therein;
an end cap attached to the second end of the main body, wherein the end cap comprises
a base adjacent to the second end of the main body, wherein the base comprises one or more vent openings to one or more vent paths,
a side wall extending from the base, wherein the side wall defines an interior cavity,
and the one or more vent paths, wherein each of the one or more vent paths provides fluid communication between at least one of the one or more vent openings and at least one of one or more vent holes in an exterior surface of the side wall; and
an electronic system within the interior cavity of the end cap.

2. The grip of claim 1, wherein the main body is substantially cylindrical.

3. The grip of claim 2, wherein the end cap is circular in plan view.

4. The grip of claim 3, wherein the side wall of the end cap is annular.

5. The grip of claim 4, wherein the electronic system is circular in plan view.

6. The grip of claim 1, wherein each of the one or more vent openings is in a region of the base that defines a base of the interior cavity, so as to provide fluid communication between the shaft cavity of the main body and the interior cavity.

7. The grip of claim 6, wherein each of the one or more vent paths comprises a groove that extends outward through an interior surface of the region of the base that defines the base of the interior cavity, and up an interior surface of the side wall, to at least one of the one or more vent holes, such that each vent path provides fluid communication through the interior cavity around the electronic system.

8. The grip of claim 7, wherein the one or more vent openings consist of a single vent opening in a center of the region of the base that defines the base of the interior cavity.

9. The grip of claim 8, wherein the one or more vent paths comprise a plurality of vent paths radiating outward from the single vent opening in the center of the region of the base that defines the base of the interior cavity.

10. The grip of claim 9, wherein the plurality of vent paths are equidistantly spaced apart from each other around a longitudinal axis of the grip.

11. The grip of claim 10, wherein the plurality of vent paths comprises at least four vent paths.

12. The grip of claim 11, wherein the plurality of vent paths consists of four vent paths.

13. The grip of claim 1, wherein, in a cross-sectional view along a longitudinal axis of the grip, the side wall has a first inner diameter around the longitudinal axis, extends from the base for a height h, and curves inward toward the longitudinal axis to a second inner diameter around the longitudinal axis that is less than first inner diameter.

14. The grip of claim 13, wherein the electronic system has an outer diameter that is equal to or less than the first inner diameter but greater than the second inner diameter, and wherein the electronic system has a height that is equal to or less than the height h.

15. The grip of claim 1, wherein the electronic system comprises at least one sensor.

16. The grip of claim 15, wherein the electronic system further comprises:
at least one wireless transmitter; and
at least one processor configured to transmit data, derived from the at least one sensor, over the at least one wireless transmitter to an external device.

17. The grip of claim 1, wherein the shaft cavity is configured in shape and size to receive a handle of a golf club, and wherein an exterior surface of the main body is textured.

18. The grip of claim 1, wherein each of the one or more vent paths corresponds one-to-one with one of the one or more vent openings and corresponds one-to-one with one of the one or more vent holes, so as to provide fluid communication between a corresponding vent opening and a corresponding vent hole.

19. The grip of claim 18, wherein each of the one or more vent paths comprises a straight linear path between its corresponding vent opening and its corresponding vent hole.

20. The grip of claim 1, wherein the one or more vent holes are in a top exterior surface of the side wall.

21. The grip of claim 1, wherein the main body further comprises one or more vent holes through a side of the main body, wherein each of the one or more vent holes in the main body provides fluid communication between the shaft cavity and an exterior of the main body.

* * * * *